US006279840B1

(12) United States Patent
Buckley

(10) Patent No.: US 6,279,840 B1
(45) Date of Patent: Aug. 28, 2001

(54) FUEL INJECTOR

(75) Inventor: Paul Buckley, Rainham (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/520,458

(22) Filed: Mar. 8, 2000

(30) Foreign Application Priority Data

Mar. 9, 1999 (GB) ..... 9905231

(51) Int. Cl.[7] ..... F02M 61/06

(52) U.S. Cl. ..... 239/533.4; 239/533.12; 239/585.5

(58) Field of Search ..... 239/533.2, 533.3, 239/533.4, 533.12, 585.1, 585.4, 585.5; 123/305, 299, 300

(56) References Cited

U.S. PATENT DOCUMENTS 3,339,848 * 9/1967 Geiger .
4,526,323 * 7/1985 Seifert ..... 239/533.4
4,546,739 * 10/1985 Nakajima et al. ..... 239/533.4
4,570,853 * 2/1986 Schmeid ..... 239/533.3
4,658,824 * 4/1987 Scheibe ..... 239/533.3
5,458,292 * 10/1995 Hapeman ..... 239/533.4
5,551,634 * 9/1996 Raab et al. ..... 239/533.3
5,899,389 * 5/1999 Pataki et al. ..... 239/533.2

* cited by examiner

*Primary Examiner*—David A. Scherbel
*Assistant Examiner*—Christopher S. Kim
(74) *Attorney, Agent, or Firm*—Patrick M. Griffin

(57) ABSTRACT

A fuel injector having a nozzle body defining a bore, an outwardly opening valve member slidable within the bore, the valve member defining a blind bore within which an inwardly opening valve needle is slidable, the valve needle being engageable with a seating to control fuel flow towards a first outlet opening provided in the valve member, and a second outlet opening provided in the valve member, the second outlet opening being in constant communication with a part of the blind bore upstream of the seating and being located such that, in a closed position of the valve member, the second outlet opening is closed by the nozzle body, outward movement of the valve member to an open position permitting fuel delivery through the second outlet opening.

6 Claims, 3 Drawing Sheets

FUEL INJECTOR

TECHNICAL FIELD

This invention relates to a fuel injector for use in supplying fuel under pressure to a combustion space of an internal combustion engine. The invention relates, in particular, to an injector suitable for use in supplying fuel to an engine of the compression ignition type, the injector forming part of a common rail fuel system. It will be appreciated, however, that the injector may be used in other applications.

BACKGROUND OF THE INVENTION

In order to reduce the levels of noise and particulate emissions produced by an engine it is desirable to provide an arrangement whereby the rate at which fuel is delivered to the engine can be controlled. It is also desirable to be able to adjust other injection characteristics, for example the spray pattern formed by the delivery of fuel by an injector. It is an object of the invention to provide a fuel injector which permits these requirements to be met.

According to the present invention there is provided a fuel injector comprising a nozzle body defining a bore, an outwardly opening valve member slidable within the bore, the valve member defining a blind bore within which an inwardly opening valve needle is slidable, the valve needle being engageable with a seating to control fuel flow towards a first outlet opening provided in the valve member, and a second outlet opening provided in the valve member, the second outlet opening being in constant communication with a part of the blind bore upstream of the seating and being located such that, in a closed position of the valve member, the second outlet opening is closed by the nozzle body, outward movement of the valve member to an open position permitting fuel delivery through the second outlet opening.

In such an arrangement, with the valve member in its closed position, movement of the needle away from the seating permits fuel delivery through the first outlet opening, thus the injection characteristics, for example the delivery rate and spray formation, are governed by the shape, size and positioning of the first opening. With the valve needle in engagement with its seating, movement of the valve member from its closed position to its open position permits fuel delivery through the second opening thus the injection characteristics are governed by the shape, size and positioning of the second outlet opening.

If desired, the valve member may be provided with a plurality of appropriately positioned said first outlet openings and a plurality of appropriately positioned said second outlet openings.

Conveniently, movement of the valve member is transmitted through the valve needle. In such an arrangement, a bidirectional actuator is preferably associated with the valve needle, the actuator permitting movement of the needle in one direction to permit fuel delivery through the first outlet opening and in an opposite direction to move the valve needle and the valve member to permit fuel delivery through the second outlet opening.

BRIEF DESCRIPTION OF THE DRAWINGS

The invention will further be described, by way of example, with reference to the accompanying drawings, in which.

DESCRIPTION OF THE PREFERRED EMBODIMENTS

Figure 1:
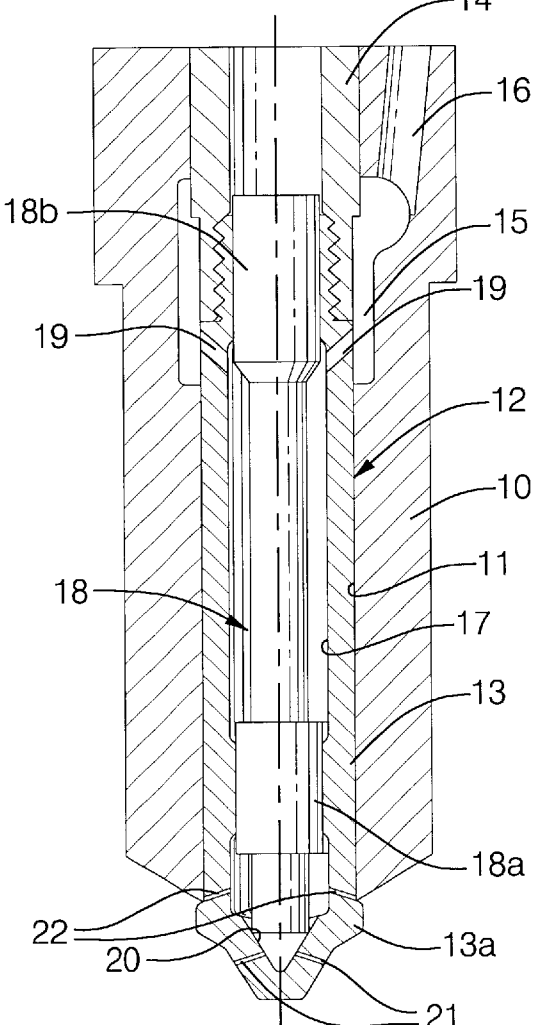
FIG. 1 is a sectional view of part of a fuel injector in accordance with an embodiment.

The fuel injector illustrated, in part, in FIG. 1 comprises a nozzle body 10 having a through bore 11 formed therein. A two-part valve member 12 is slidable within the bore 11, the valve member 12 comprising a lower part 13 of diameter substantially equal to the diameter of the adjacent part of the bore 11 and including, adjacent its lower end in the orientation illustrated, a region 13*a* of enlarged diameter which protrudes from the bore 11 and is engageable with an external surface of the nozzle body 10. The upper end region of the part 13 is externally screw-threaded and is in screw-threaded engagement with a part 14 of the valve member 12 of diameter substantially equal to the diameter of the adjacent part of the bore 11. The region of the bore 11 adjacent the part 14 of the valve member 12 is of diameter greater than the region of the bore 11 adjacent the part 13 of the valve member 12. Intermediate these regions of the bore 11, an annular chamber 15 is defined between the bore 11 and the valve member 12, the chamber 15 communicating with a supply passage 16 which communicates, in use, with a source of fuel under high pressure, for example a common rail of a common rail fuel system, the common rail being arranged to be charged to a suitably high pressure by an appropriate high pressure fuel pump.

The parts 13, 14 of the valve member 12 are provided with bores which together form a blind bore 17 within which a valve needle 18 is slidable. The bore 17 communicates with the annular chamber 15 through a plurality of drillings 19 provided in the part 13 of the valve member 12. The valve needle 18 is provided with guide regions 18*a*, 18*b* of diameter substantially equal to the diameter of the adjacent parts of the bore 17, and arranged to guide the needle 18 for sliding movement within the valve member 12. In order to ensure that fuel flow within the bore 17 is uninhibited by the guide region 18*a* the portion of the needle 18 defining the guide region 18*a* is conveniently provided with flutes or other formations (not shown) permitting the flow of fuel past the guide region 18*a*.

The part of the needle 18 adjacent the blind end of the bore 17 is of frusto-conical form and is arranged to engage a seating surface 20 defined adjacent the blind end of the bore 17. Engagement of the needle 18 within the seating surface 20 controls the supply of fuel from the bore 17 to a plurality of first outlet openings 21. In the embodiment illustrated, the inner ends of the first openings 21 are arranged to be closed by the needle 18 when the needle 18 engages the seating surface 20. However, if desired, the openings 21 may communicate with a chamber or sac located downstream of a seating surface 20 with which the needle 18 is engageable.

Upstream of the seating surface 20, the part 13 is provided with a plurality of second outlet openings 22, the second outlet openings 22 opening to the exterior of the part 13 immediately above the enlarged diameter region 13*a* thereof.

The part 14 of the valve member 12 is of diameter greater than that of the part 13, the dimensions of these parts of the valve member 12 having been chosen to ensure that the application of fuel under high pressure to the chamber 15 and the bore 17 applies a biasing force to the valve member 12 biasing the valve member 12 towards a closed position as illustrated in FIG. 1. In this position, the enlarged diameter region 13*a* of the part 13 engages the lower end surface of the nozzle body 10, and the second outlet openings 22 are closed by the nozzle body 10. It will be appreciated that, in this position, fuel delivery through the second outlet openings 22 is not permitted. Although not illustrated in FIG. 1, an appropriate biasing force is conveniently applied to the valve member 12 to ensure that, at rest, the valve member 12 occupies its closed position, assisting the action of the fuel under pressure, and to ensure that the valve member 12 occupies its closed position when the fuel system is not in use, and fuel under high pressure is not applied to the chamber 15 or bore 17.

An appropriate actuator (not shown in FIG. 1) is associated with the injector, the actuator applying a force to the needle 18, when injection is not to take place, urging the needle 18 into engagement with the seating surface 20. It will be appreciated that the engagement of the needle 18 with the seating surface 20 ensures that fuel is not permitted to flow from the bore 17 to the first outlet openings 21. As a result, fuel injection through the first outlet openings 21 does not take place.

Figure 2:
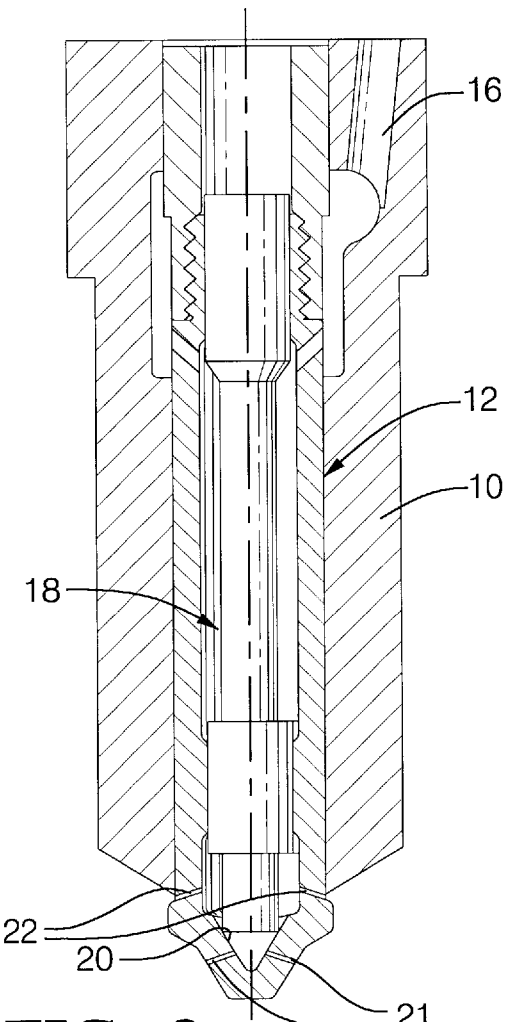

Referring to FIG. 2, when injection of fuel is desired through the second outlet openings 22, the magnitude of the force applied by the actuator to the needle 18 urging the needle 18 in a downward direction in the orientation illustrated is increased. The increase in the downward force applied to the needle 18 is sufficient to cause movement of the needle 18 and the valve member 12 with which the needle 18 is in engagement against the action of the fuel under pressure within the chamber 15 and bore 17 and against the action of any spring biasing force associated with the valve member 12, moving the valve member 12 from the closed position illustrated in FIG. 1 to an open position as illustrated in FIG. 2. In this position, as the valve needle 18 is still in engagement with the seating surface 20, injection of fuel does not occur through the first outlet openings 21. However, the downward movement of the valve member 12 results in the second outlet openings 22 moving to positions in which they are no longer obscured by the nozzle body 10, and fuel delivery occurs through the second outlet openings 22. It will be appreciated that the rate at which fuel is delivered and the other injection characteristics are dependent upon the fuel pressure applied to the injector and upon the shape, size, position and number of second outlet openings 22.

In order to terminate delivery through the second outlet openings 22, the actuator is returned to its original condition, the valve member 12 and needle 18 returning to the positions illustrated in FIG. 1 under the action of the fuel under pressure within the chamber 15 and bore 17 and the action of any spring biasing associated with the valve member 12.

Figure 3:
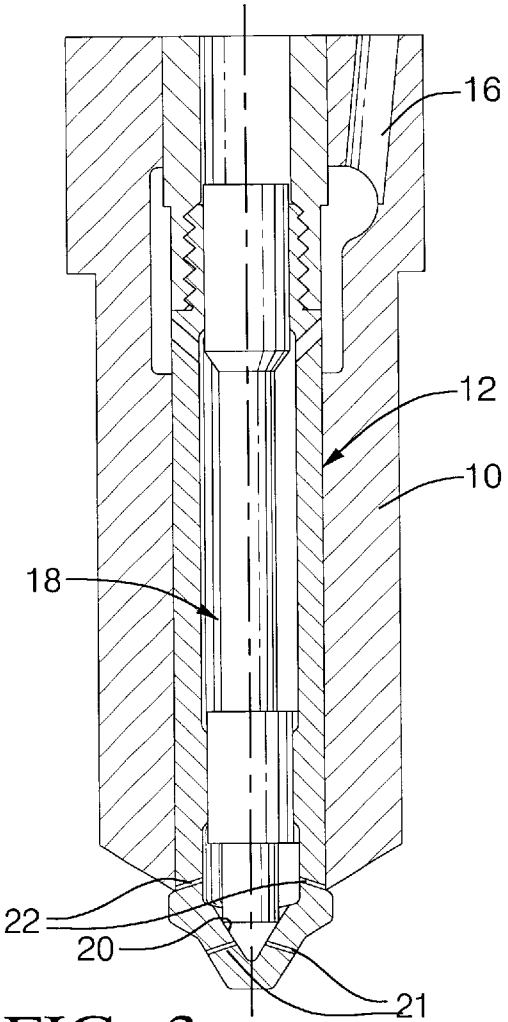
FIGS. 2 and 3 are views similar to FIG. 1 illustrating the injector, in use.

With reference to FIG. 3, when delivery of fuel is required through the first outlet openings 21, the actuator is operated to reduce the magnitude of the downward force applied to the needle 18. As a result, the action of the fuel under pressure within the bore 17 which applies a force to the needle 18 urging the needle 18 in an upward direction causes upward movement of the needle 18. Such movement of the needle 18 lifts the lower end thereof away from the seating surface 20, thus permitting fuel to flow from the bore 17 to the first outlet openings 21. It will be understood that the rate at which fuel is delivered for any given fuel pressure and the other injection characteristics will be dependent upon the number, size, position and shape of the outlet openings 21.

Delivery of fuel through the first outlet openings 21 is terminated by returning the actuator to its original condition, thereby ensuring that the needle 18 returns to the position illustrated in FIG. 1.

By appropriately selecting, for example the sizes of the first outlet openings 21 and second outlet openings 22, it will be understood that different fuel flow rates or spray formations may be produced when fuel is delivered through the first outlet openings 21 compared to those where fuel is delivered through the second outlet openings 22, thus the injection characteristics can be controlled by controlling the direction of movement of the needle 18 from its rest position, in use.

In an alternative embodiment to that shown in FIGS. 1–3, the outer surface of the valve needle 12 may be shaped to define a seating surface which is engageable with a corresponding seating surface defined by the nozzle body 10 such that, upon engagement between said seating surfaces, fuel is unable to escape through the second outlet openings 22 into the engine cylinder or other combustion space.

Figure 4:
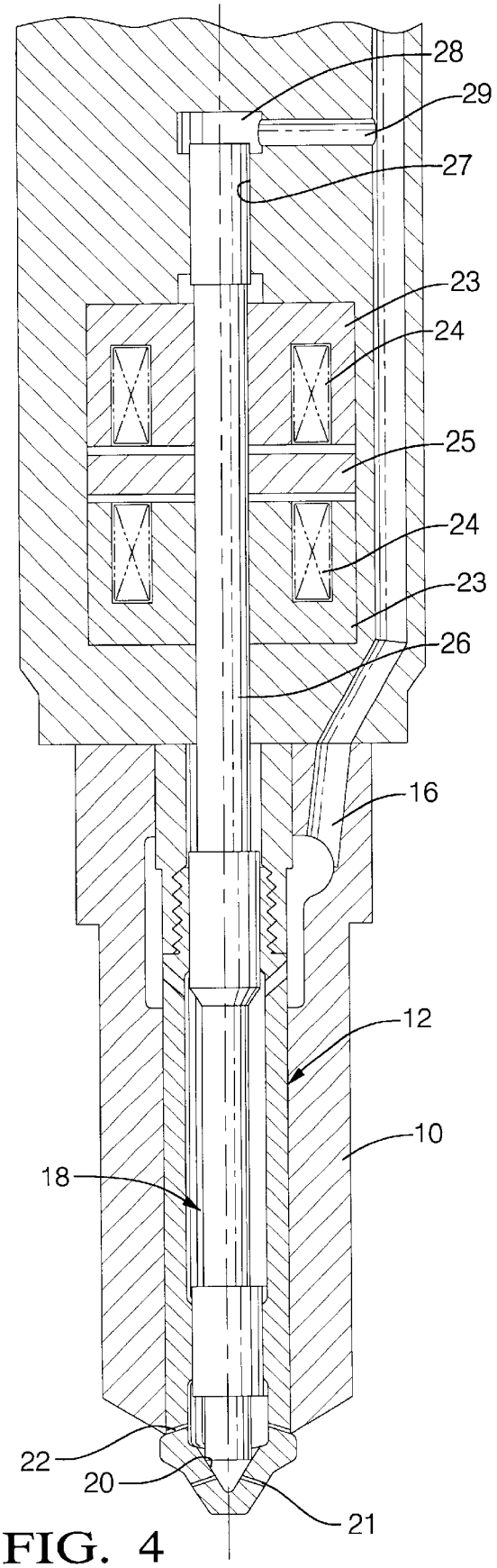
FIGS. 4 and 5 illustrate two techniques for actuating the injector.

FIG. 4 illustrates an actuator arrangement suitable for use with the injector of FIGS. 1 to 3. Although not illustrated in FIG. 4, a spring biasing arrangement may be provided to bias the valve member 12 towards its closed position and to bias the valve needle 18 into engagement with the seating surface 20.

The actuator arrangement illustrated in FIG. 4 takes the form of an electromagnetic actuator including a pair of cores 23 with respective windings 24 associated therewith. An armature 25 is located intermediate the cores 23, the armature 25 being mounted upon a load transmitting member 26, the lower end of which abuts or is secured to the upper end of the valve needle 18. The upper end of the load transmitting member 26 is slidable within a bore 27 in a piston-like manner and defines, with the bore 27, a chamber 28 which communicates through a drilling 29 with the supply passage 16. As a result, the application of fuel under pressure to the supply passage applies a biasing force to the load transmitting member 26 which is transmitted to the needle 18, urging the needle 18 into engagement with the seating 20. The dimensions of the bore 27 and the upper part of the load transmitting member 26 are chosen, depending upon the intended application, to result in the needle being substantially pressure balanced thereby reducing the magnitude of actuator forces which must be applied, in use.

In use, in order to cause delivery of fuel through the first outlet openings 21, the winding 24 associated with the upper core 23 is energized, attracting the armature 25 and applying a force to the load transmitting member 26 acting against the action of fuel under pressure within the chamber 28 and any spring biasing of the needle 18 thus reducing the magnitude of the downward force applied to the needle 18 and permitting movement of the needle 18 in an upward direction as described hereinbefore. When the winding 24 associated with the upper core 23 is de-energized, the action of the fuel under pressure within the chamber 28 together with any spring biasing of the needle 18 apply a force to the needle 18 returning the needle 18 to its original position.

When fuel is to be delivered through the second outlet openings 22, the winding 24 associated with the lower core 23 is energized attracting the armature 25 and applying a force to the load transmitting member 26 in a downward direction. The force is applied to the needle 18 and, due to the engagement between the needle 18 and the seating surface 20, is transmitted to the valve member 12, resulting in movement of the valve member 12 to the position illustrated in FIG. 2. As a result, fuel injection through the second outlet openings 22 but not the first outlet openings 21 occurs. In order to terminate injection, the winding 24 associated with the lower core 23 is deenergized, and the valve member 12 returns to the position illustrated in FIG. 1 due to the action of the fuel under pressure within the chamber 15 and bore 17, in conjunction with any spring biasing associated with the valve member 12.

Figure 5:
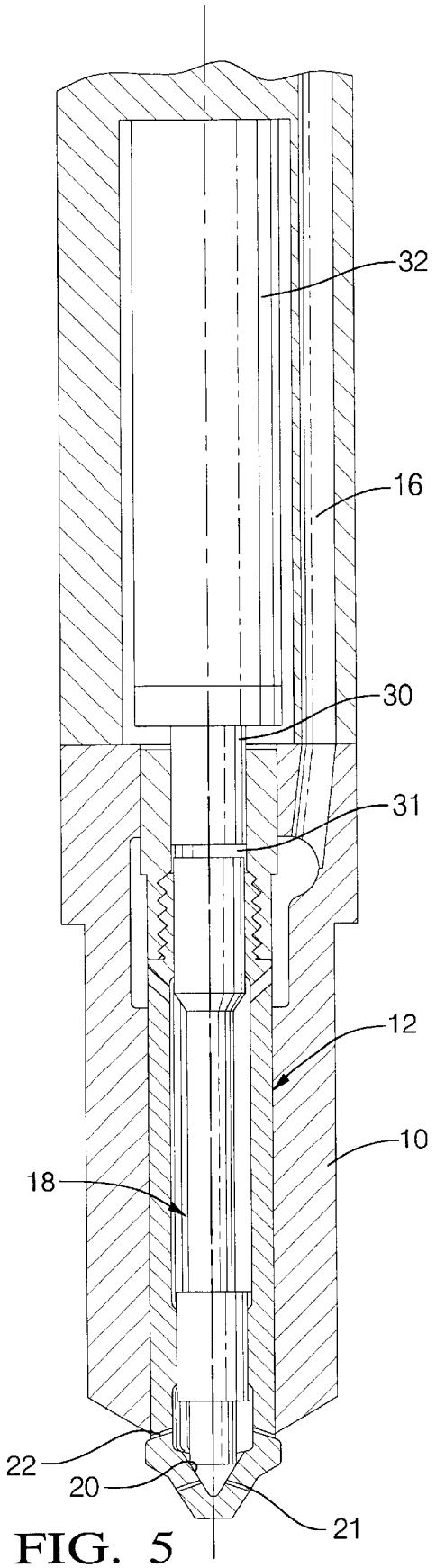

FIG. 5 illustrates an alternative actuation arrangement. In the arrangement of FIG. 5, a piston member 30 is located within the part of the bore 17 defined by the upper part 14 of the valve member 12. The piston member 30, bore and valve needle 18 together define a chamber 31 to which fuel can flow at a restricted rate from the bore 17 between the guide region 18*b* of the needle 18 and the wall of the bore 17. The piston member 30 is secured to a piezoelectric actuator stack 32, energization of which is controlled by an appropriate electronic control arrangement.

When fuel delivery is not to take place, the stack 32 is energized to an intermediate level, and the valve member 12 and needle 18 occupy the position illustrated in FIG. 1. In order to cause delivery of fuel through the first outlet openings 21, the energization level of the stack 32 is altered to cause a reduction in its axial length. As a result, the piston 30 moves in an upward direction, reducing the fuel pressure within the chamber 31, and a point will be reached beyond which the fuel pressure within the bore 17 acting upon the needle 18 is sufficient to overcome the action of the fuel pressure within the chamber 31 and any spring biasing, whereon the needle 18 will lift from the seating surface 20 and fuel delivery through the first outlet openings 21 will occur as illustrated in FIG. 3. In order to terminate injection, the actuator 32 is returned to its original energization level, re-pressurizing the chamber 31 and returning the needle 18 to the position illustrated in FIG. 1.

In order to cause delivery of fuel through the second outlet openings 22, the energization level of the stack 32 is altered to increase the axial length of the stack 32, causing the piston 30 to move in a downward direction, increasing the fuel pressure within the chamber 31. As a result, the magnitude of the downward force applied to the needle 18 will increase, the downward force being transmitted to the valve member 12 and a point will be reached beyond which the valve member 12 will move in a downward direction to the position illustrated in FIGS. 2 and 5. In order to terminate injection, the stack 22 is returned to its original energization state, thus permitting the fuel pressure within the chamber 31 to fall and as a result, the needle 18 and valve member 12 return to the position illustrated in FIG. 1.

The provision of the chamber 31 is advantageous compared to an arrangement in which the needle 18 is coupled directly to the stack 32 in that leakage of fuel to or from the chamber 31 at a restricted rate will compensate for thermal expansion of the stack 32, creep under load or elastic movement due to changes in the fuel pressure applied to the injector.

Rather than arrange for the actuator to occupy an intermediate energisation level when injection is not occurring, an actuator of the type in which reverse actuation is possible upon the application of a negative voltage could be used.

It will be appreciated that other types of actuator may be used, and that the invention extends to the use of such actuators with the injector described hereinbefore.

Figure 6:
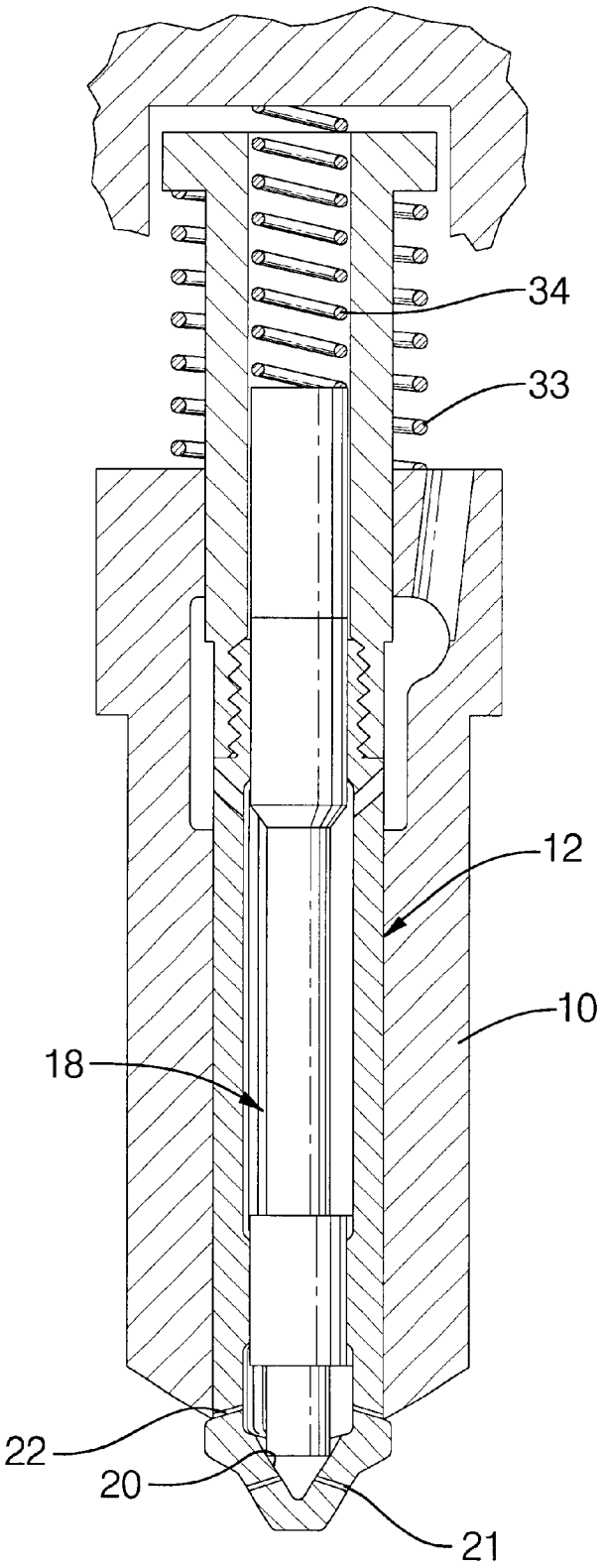
FIG. 6 illustrates, diagrammatically, a spring biasing regime which is suitable for use in the injector.

Although the spring biasing of the valve member 12 and needle 18 is not illustrated in either the arrangement of FIG. 4 or that of FIG. 5, it will be appreciated that such spring biasing is advantageous in that, when fuel under pressure is not applied to the injector, the spring biasing will hold the valve needle 18 and valve member 12 in the positions illustrated in FIG. 1. FIG. 6 illustrates, diagrammatically, a suitable spring biasing regime for the valve needle 18 and the valve member 12. As illustrated in FIG. 6, a first spring 33 is provided which applies an upwardly directed biasing force to the valve member 12, urging the valve member 12 towards the closed position illustrated in FIG. 1. A second spring 34 applies a downwardly directed biasing force to the needle 18 urging the needle 18 into engagement with the seating surface 20 as illustrated in FIG. 1. The location of the springs to achieve the application of such biasing forces need not be as illustrated in FIG. 6. For example, where a load transmitting member 26 is provided as illustrated in FIG. 4, then the second spring 34 may act upon the load transmitting member 26 rather than directly upon the needle 18.

What is claimed is:

1. A fuel injector comprising, a nozzle body defining a bore, an outwardly opening valve member slidable within said bore, said valve member defining a blind bore within which an inwardly opening valve needle is slidable, said valve needle being engageable with a seating to control fuel flow towards a first outlet opening provided in said valve member and a second outlet opening provided in said valve member, said second outlet opening being in constant communication with a part of said blind bore upstream of said seating and being located such that, in a closed position of said valve member, said second outlet opening is closed by said nozzle body, outward movement of said valve member to an open position permitting fuel delivery through said second outlet opening, the valve needle being arranged such that inward movement of the valve needle in a direction away from the seating permits fuel delivery through the first outlet opening.

2. A fuel injector, comprising: a nozzle body defining a bore, an outwardly opening valve member slidable within said bore, said valve member defining a blind bore within which an inwardly opening valve needle is slidable, said valve needle being engageable with a seating to control fuel flow towards a first outlet opening provided in said valve member, and a second outlet opening provided in said valve member, said second outlet opening being in constant communication with a part of said blind bore upstream of said seating and being located such that, in a closed position of said valve member, said second outlet opening is closed by said nozzle body, outward movement of said valve member to an open position permitting fuel delivery through said second outlet opening and wherein a force for moving said valve member is transmitted through said valve needle.

3. A fuel injector as claimed in claim 2 wherein an actuator is associated with said valve needle so as to permit movement of said needle in one direction to permit fuel delivery through said first outlet opening and in an opposite direction to move said valve needle and said valve member to permit fuel delivery through said second outlet opening.

4. A fuel injector as claimed in claim 3, wherein said actuator is bidirectional.

5. A fuel injector as claimed in claim 2, wherein the outer surface of the valve member is shaped to define a seating surface which is engageable with a corresponding seating surface defined by the nozzle body, whereby engagement between said seating surfaces, in use, causes the second outlet opening to be closed so as to prevent fuel delivery through the second outlet opening.

6. A fuel injector as claimed in claim 5, having a plurality of appropriately positioned said first outlet openings and a plurality of appropriately positioned said second outlet openings.

* * * * *